United States Patent [19]

Sayles

[11] Patent Number: 4,952,341

[45] Date of Patent: Aug. 28, 1990

[54] MECHANICAL ENHANCEMENT OF THE BURNING RATE OF SOLID PROPELLANTS BY MEANS OF SHRINK TUBES OR SPHERES

[75] Inventor: David C. Sayles, Huntsville, Ala.

[73] Assignee: The United States of America as represented by the Secretary of the Army, Washington, D.C.

[21] Appl. No.: 22,121

[22] Filed: Feb. 9, 1979

[51] Int. Cl.[5] ..... C06B 45/10; C06B 21/00

[52] U.S. Cl. ..... 264/3.1; 102/289; 149/19.2; 149/19.3; 149/19.4; 149/19.6; 149/19.8; 149/19.91; 149/19.92; 149/2; 149/109.6

[58] Field of Search ..... 264/3 R, 3.1; 102/289; 149/2, 19.2, 19.3, 19.4, 19.6, 19.8, 19.91, 19.92, 109.6

[56] References Cited

U.S. PATENT DOCUMENTS

| | | | |
|---|---|---|---|
| 3,023,572 | 3/1972 | Teague | 60/35.6 |
| 3,585,799 | 8/2969 | Geschmentner | 60/250 |
| 3,677,010 | 8/1972 | Fink et al. | 60/220 |
| 3,857,239 | 12/1974 | Brock et al. | 60/204 |
| 3,901,152 | 8/1975 | Alexander | 264/3.3 |
| 3,968,724 | 7/1976 | Kowalick et al. | 86/20.1 |
| 4,090,342 | 5/1978 | Rishel | 102/324 |
| 4,709,636 | 12/1987 | Mueller et al. | 102/431 |

*Primary Examiner*—Edward A. Miller

*Attorney, Agent, or Firm*—Werten F. W. Bellamy; Jack Voight

[57] ABSTRACT

Disclosed is a method of enhancing the rate of consumption of a propellant as a result of having shrink tubes or spheres embedded in the propellant. The shrink tubes suitable for use in this method are derived from various polyurethane or polyolefin resins which undergo shrinkage when exposed to moderate heat. The mechanism of enhancement derives from the fact that when the flame front reaches the shrink tube or sphere, the tube or sphere undergoes shrinkage, and thus, exposes additional propellant surface to the burning process. High burning rate are achieved because of the apparent reduced overall propellant web created by the presence of and resultant action to these shrink tubes or spheres.

A modification of the method of this invention is to embed these plastic tubings in the propellant, raise the temperature of the propellant mass to a temperature at which the tubing will undergo shrinkage. The porosity, thus introduced into the propellant as a result of tubing shrinkage, will result in ultrahigh burning rates well beyond that achievable without prior shrinkage of tubing prior to burning the propellant mass.

A further modification of the method of this invention involves filling the thermally-shrinkable tubing with rapidly combustible propellant which would burn out more rapidly than the matrix propellant, and thus, produce even higher burning rates.

8 Claims, 1 Drawing Sheet

MECHANICAL ENHANCEMENT OF THE BURNING RATE OF SOLID PROPELLANTS BY MEANS OF SHRINK TUBES OR SPHERES

DEDICATORY CLAUSE

The invention described herein may be manufactured, used, and licensed by or for the Government for governmental purposes without the payment to me of any royalties thereon.

BACKGROUND OF THE INVENTION

Various methods have been employed to obtain high burning rate propellants. One method of obtaining very high burning rates from propellants has been through the use of aluminum staples. Other metals have been used with comparable results; however, aluminum staple of various dimensions has been preferred because of being readily available in both quality and quantity at a lesser cost than other metals.

In addition to staple, catalysts have been used to promote burning rates. At first, liquid burning rate catalysts (particularly of the organoiron or carborane types) were employed and these catalysts also, in certain cases, contributed plasticizer functions in addition to the catalysis function. Some problems associated with the use of such catalysts have been related to their relatively high volatility, their high freezing points, and their tendencies to migrate within the propellant and into the liner and insulation of the rocket motor. In order to overcome these migratory tendencies, it has been necessary to incorporate high percentages of burning rate promotor into the insulation to produce a near-equilibrium situation insofar as catalyst migration is concerned, thus further complicating the manufacture of these types of solid rocket motors.

More recently, my U.S. Pat. No. 4,034,675 disclosed another method of controlling burning rate while at the same time employing a means to eliminate combustion instability. Burning rate promotor (e.g. n-butylferrocene, n-hexylcarborane) is incorporated into resonance rods that are used to eliminate combustion instability of solid propellant. As the solid propellant burning progresses the resonance rods undergo ablation, and as ablation takes place, subsurface quantities of the burning rate promotor are exposed and continuously released into the combustion zone to catalyze the combustion process. An alternate embodiment employed porous resonance rods which contain the burning rate promotor and a selected material for suppressing combustion instability as infiltrants.

Burning rates of propellants are also influenced by surface area and particle sizes of the oxidizer ingredients. Porosity is another factor which increases burning rate of solid propellant grains. However, if porosity is not controlled the burning rate increase due to porosity as a result of processing abnormalities can lead to failure of the solid propellant grain.

Desirable would be a method to enhance the burning rate of a propellant formulation which has proven properties, both mechanical and chemical, without changing the stoichiometric balance of the formulation.

Therefore an object of this invention is to provide a mechanical enhancement of the burning rate of solid propellants by means of shrink tubes.

Another object of this invention is to provide a method of increasing the burning rate as a result of increased porosity generated, either before the propellant is ignited, or at the early burning stage of the propellant, as a result of thermally-shrinkable tubing which are incorporated into the propellant formulation.

Still another object of this invention is to provide thermally shrinkable plastic tubing which has been prior filled with a rapidly-combustible propellant prior to being incorporated into the matrix propellant which would burn more rapidly than the matrix propellant, and thus, produce even higher burning rates as a result of rapidly generated annular passageways in the propellant grain as a result of tubing shrinkage.

SUMMARY OF THE INVENTION

Lengths of thermally-shrinkable plastic tubing derived from various polyurethane or polyolefin resins are embedded in an uncured solid propellant composition. The propellant mass is cured having the tubing dispersed throughout. When the propellant is exposed to moderate heat, that is, heat forward of the flame front, the tubings undergo shrinkage, and, thus, expose additional propellant surfaces to the burning process because of the annular passageways which are generated in the propellant. The propellant mass can also be exposed to moderate heat (e.g., 250° F.), prior to propellant firing, by raising the temperature of the propellant mass to a temperature at which the tubing will undergo shrinkage. The porosity, thus introduced into the propellant, will result in ultrahigh burning rates well beyond that achievable without the prior shrinkage of tubings prior to burning of the propellant mass.

Even higher burning rates can be achieved by a further modification of the method of this invention. This modification involves filling the thermally-shrinkable tubing with rapidly-combustible propellant which would burn out more rapidly than the matrix propellant thereby increasing the total surface area for burning very effectively which results in increased burning rate.

BRIEF DESCRIPTION OF THE DRAWING

The figures of the drawing are burning rate curves which compare the burning rates of baseline propellants (without tubing) with the burning rates of propellants containing heat shrinkable tubings.

DESCRIPTION OF THE PREFERRED EMBODIMENTS

Figure 1:
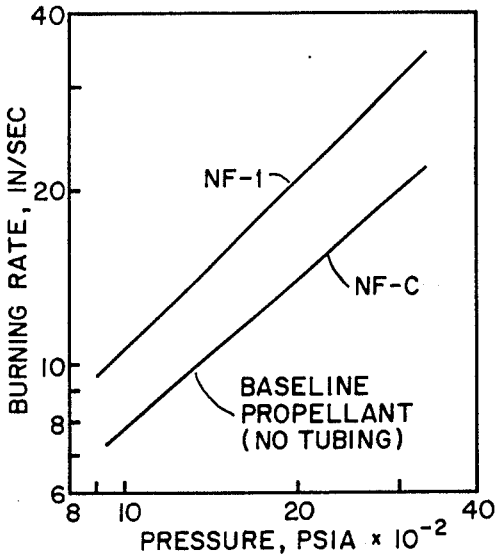
FIGS. 1, 2, and 3 depict burning rates of NF propellants.

The method of this invention relates to a mechanical enhancement of burning rate of solid propellants by means of shrink tubes. The shrink tubes suitable for use in this method are derived from various polyurethane or polyolefin resins which undergo shrinkage when exposed to moderate heat. The shrinkage of the tubes expose additional propellant surfaces to the burning process. The exposure of the tubes to heat can be accomplished during propellant burning or the propellant mass containing the tubes can be exposed to moderate heat (e.g., 250° F.) to pre-shrink the tubes prior to propellant firing thereby introducing porosity and increased surface area for burning when the propellant is fired.

The theorectical analysis which was made to determine whether the mass flow rate of a propellant would be increased by the dispersion of thermally-shrinkable tubing into the propellant is summarized as follows:

The mass flow rate is equal to the product of the propellant density, the burning surface area and the burning rate, Thus:

$$\dot{m}=\rho_b A_b r_b=\rho_b A_b' r_b'$$

where:

m=mass flow rate $\rho_b$=density $A_b$=burning surface area $r_b$=burning rate and $A_b'$ and $r_b'$ are the corresponding parameters for the propellant containing thermally-shrinkable tubing.

If $\dot{m}$ for both propellants were held constant, the increase in surface area ($A_b'/A_b$) required for the propellant containing the thermally-shrinkable tubing is obtained by:

$$r_b=A_b' r_b'/A_b$$

Thus, a 10% increase in effective burning surface would permit the use of a propellant having a 10% lower burning rate and still produce the same mass flow discharge.

From this calculation, it was concluded that for the greatest burning rate enhancement, the thermally-shrinkable additives should be small in volume and capable of generating a large increase in surface area (large surface area to volume ratio) to be most effective.

The "response time" or "action time" for tubing shrinkage was the determinant insofar as burning rate amplification was concerned. Clearly, to achieve burning rate amplification, it would be necessary for the thermally-shrinkable tubing to attain its shrink temperature, and undergo shrinkage within an extremely short period.

There are different approaches that can be used in taking advantage of the burning rate accelerator by these thermally-shrinkable tubings. One approach consists of employing a tubing which, when exposed to the heat forward of the flame front, will cause the tubing to undergo shrinkage, and, thus, expose additional propellant surface to the burning process because of the annular passageway which is generated into the propellant. Another approach is to embed these plastic tubings in the propellant, raise the temperature of the propellant mass to a temperature at which the tubing will undergo shrinkage. The porosity, thus introduced into the propellant, will result in ultrahigh burning rates well beyond that achievable without the tubing. A further modification of this process involves filling the thermally-shrinkable tubing with rapidly-combustible propellant which would burn out more rapidly than the matrix propellant, and thus, produce even higher burning rates.

A preliminary evaluation of the effects of adding thermally-shrinkable tubing to a solid propellant was made. The tubing used was 0.085-in. outer diameter and 0.046-in. inner diameter polyolefin tubing. This tubing shrinks to 0.023-in. inner diameter after heating to approximately 110° C. It was arbitrarily cut to lengths of 0.05-in. for incorporation into the propellant.

The propellant used had the following formulation:

| INGREDIENT | WEIGHT % |
|---|---|
| Ethyl Acrylate-Acrylic Acid (90–10) | |
| Trisvinoxypropyl Adduct (TVOPA)* | 30.6 |
| ERL 4221** | 1.4 |
| Carboranylmethyl Propionate | 4.0 |
| Graphite Linters (100 micrometers) | 2.0 |
| Aluminum Powder (Alcoa 123) | 11.0 |
| Aluminum Flake (IRECO 2010) | 1.0 |
| Ammonium Perchlorate (0.9 micrometer) | 50.0 |
| Lecithin | 0.1 |
| PROPELLANT CHARACTERISTICS | |
| Specific Impulse (Theoretical) (lbf-s/lbm) | 263.6 |
| Density (lb/in$^3$) | 0.0637 |
| Strand Burning Rates (ips) | |
| (@ 1000 psi) | 13.7 |
| (@ 2000 psi) | 21.6 |
| Pressure Exponent | 0.68 |
| End-of-Mix Viscosity (KP @ 132° F.) | 10.6 |

*Binder ingredients TVOPA - 1,2,3-tris [1,2-bis(difluoromino)ethoxy] propane, a difluoromino plasticizer for ethyl acrylate-acrylic acid copolymer (EA-AA) binder which when cured forms the energetic binder for the propellant system.

**Curing agent, 4,5-epoxycyclohexylmethyl 4',5'-epoxycyclohexylcarboxylate

Strands were cast from part of the mix to provide a burning rate control.

To the remainder, 1% (by weight) of the cut, thermally-collapsible tubing was added. The change which occurred in the End-Of-Mix viscosity as a result of the addition of the tubing was from 10.6 to 12.5 KP. The specimens were then cured, and burning rate strands were burned to determine the change in burning rate.

The burning rates which were obtained with propellants of the same formulation with and without the thermally-collapsible tubing are as follows:

| BURNING RATE IPS | PRESSURE (PSI) 1000 | PRESSURE (PSI) 2000 | PRESSURE EXPONENT |
|---|---|---|---|
| Without Tubing | 9.6 | 18.0 | 0.87 |
| With Tubing | 14.6 | 23.3 | 0.74 |

The tubing produced a burning rate increase at an operating pressure of 2000 psi of 29%, coupled with a lowering of the pressure exponent.

Further evaluations of the method of this invention were made by incorporating heat-shrinkable tubing in a NF propellant composition and a double base propellant composition. The description of the experimental technique and effect of heat-shrinkable tubing are set forth hereinbelow along with the baseline propellant compositions in which the heat-shrinkable tubings were incorporated.

EFFECT OF HEAT-SHRINKABLE TUBING IN PREHEATED PROPELLANT SYSTEM

When samples of propellant which contained heat-shrinkable tubing were heated to 250° F., and held at this temperature for a short period of time so that the tubing could undergo shrinkage "in situ", the burning rates of samples of these propellants, as measured in a strand burner, showed a major increase in burning rates over samples which did not contain any heat-shrinkable tubing.

This aspect of the investigation was intended to demonstrate the effect of incorporating heat-shrinkable tubing and the preheating of the propellant on burning rate. This combination produced the maximum increase in burning rate that could be achieved from such a system.

This also demonstrated the largest increase in burning rate that could be expected from a propellant which contained heat-shrinkable tubing under actual use conditions where, during propellant combustion the shrinkable tubing would shrink the maximum amount when reached by the flamefront.

The effectiveness of tubing to enhance the burning rate of propellants was found to be dependent upon the "response time" or "action time" for shrinkage. To achieve the highest burning rate from such a system, the tubing needs to attain the shrink temperature, and undergo full shrinkage within an extremely short time frame, probably of the order of milliseconds. Preshrinkage by prior thermal treatment confirmed the efficacy of shrink tubing as a burning rate accelerator.

Thus, to demonstrate the maximum effect on burning rate that could be obtained from the incorporation of heat-shrinkable tubing into a propellant, the technique that was resorted to consisted of preheating the tubing-containing propellant to 250° F. Under such treatment, the tubing underwent shrinkage in a very brief period of time. Preshrinkage of the tubing by thermal treatment prior to test introduced the porosity which resulted in burning rate amplification.

These observations confirmed the validity of the thermal shrinking tubing concept, that is, that shrinkage of tubing accompanied by matrix/filler debonding can produce the desired burning rate amplification.

This approach would be a procedure for obtaining high burning rates from propellants especially with propellants that need to be heat-sterilized for outerspace applications.

Tables I and II set forth baseline propellant compositions NF (NF propellant composition, i.e., propellant containing a difluoroamino compound) and DB (double-base propellant composition) which were used as the control propellants for the evaluations of the method of this invention. The modified propellants were made by incorporating various percentages of heat-shrinkable propellant therein.

The propellant compositions of Tables I and II are curable propellants whose ingredients can be varied to achieve the desired performances and be curable to retain the mechanical properties required for the end use. The formulations shown are representative of propellants for use in the preferred embodiments whose burning rates can be enhanced by the method of this invention. These formulations were chosen because of their proven properties, both mechanical and chemical. The advantages of a method to enhance the burning rate of these proven formulations without changing the stoichiometric balance is recognized by the skilled artisan.

TABLE I

BASELINE NF PROPELLANT COMPOSITION

| | Weight Percent |
|---|---|
| Ethyl Acrylate-Acrylic Acid (95:5) | 3.00 |
| TVOPA* | 29.99 |
| ERL-4221** | 2.01 |
| Ammonium Perchlorate (1 mμ) (0.3% BITA***) | 52.00 |
| Carboranylmethyl Propionate | 4.00 |
| Aluminum Powder (ALCOA 123) | 10.00 |
| Aluminum Flake (ALCOA 606) | 2.00 |
| Lecithin | 0.10 |

*Tris-1,2,3-[bis(1,2-difluoroamino)ethoxy] propane
**4,5-Epoxycyclohexylmethyl 4',5'-epoxycyclohexylcarboxylate
***Tris[2-ethylaziridinyl]1,3,5-benzene-1,3,5-tricarboxamide

TABLE II

BASELINE DOUBLE-BASE (DB) PROPELLANT COMPOSITION

| Ingredient | Weight percent |
|---|---|
| Nitrocellulose Lacquer | 39.43 |
| Methyl Nadic Anhydride | 1.00 |
| Carbon Black | 0.20 |
| Lead Peroxide | 0.30 |
| Stannic Oxide | 1.40 |
| HMX (Cyclotetramethylenetetranitramine) (Class E) | 56.30 |
| Hexamethylene Diisocyanate | 1.37 |
| Triphenylbismuthine | 0.03 |
| Maleic Anhydride | 0.03 |
| Magnesium Oxide | 0.03 |

Table III, sets forth descriptive information about a typical heat-shrinkable tubing which is satisfactory for use in accordance with this invention. Polyolefin white tubings, stretched or non-stretched, as described hereinabove, also proved effective for use in accordance with this invention.

TABLE III

HEAT-SHRINKABLE TUBING

| | |
|---|---|
| Polymer Type | Polyolefin |
| Color | Black |
| Outer Diameter (in) | 0.085 |
| Inner Diameter (in) | 0.046 |
| Length (in) | 0.05 |
| Manufacturer | L. Frank Markel & Sons, Inc. Morristown, PA |
| Shrink Temperature Range (°C.) | 115–120 |

Dimensional Changes on Shrinkage

| Before | | After |
|---|---|---|
| Diameter (in) | 0.085 | 0.0654 + 0.0008 |
| Length (in) | 0.0493 + 0.0023 | 0.044 + 0.0029 |
| Percent Shrinkage | | |
| (Diameter) | 23% | |
| (Length) | 11% | |
| Density | 1.3930 | 1.566- |
| Percent Increase in Density | 12% | |

Other heat-shrinkable types of tubing which were evaluated for use in this invention included those distributed under the name Mylar, polyvinyl chloride, etc., either as clear materials or pigmented black and pigmented white. The heat shrinkable tubings of the polyurethane or polyolefin types, described in greater detail below, were found to be satisfactory for use in this invention.

In the manufacture of thermally-shrinkable material, the polymeric binder is formed into the desired shape, such as, hollow tubing, and then it is highly crosslinked. It is then heated to a temperature above that necessary to effect melting of the crystallites, and expanded to the desired diameter by stretching the crosslinked molecules. Upon cooling in the stretched state, crystallite formation is primarily responsible for "freezing" the structure in the stretched state.

Upon exposure of the stretched thermally-shrinkable material to heat, crystallite melting permits the stored elastic energy in the crosslinked network to contract the elastomeric tubing to its original undeformed shape. Upon cooling, the crystallites are reformed again, and this freezes the elastomer in its shrunken shape.

It was found that the commercially-available thermally-shrinkable tubing required temperatures of the order of 100°–200° C. to melt the crystallites, and then shrinkage could take place. Thus, one of the critical factors which would control the response of the thermally-shrinkable material would be the rate of heat transfer from the flame/fizz zone to the material in order to cause retraction to occur.

The retraction mechanism must also depend upon the internal polymeric parameters, such as, the inherent viscosity of the network, crosslink density, amount of expansion that the material has undergone and the thermal properties.

Tubing having a predetermined inside diameter from about 0.030 inch to about 0.125 inch with a wall thickness of about 0.040 inch to provide an outer diameter from about 0.070 to about 0.165 were tested after being cut in predetermined lengths from about 0.050 inch to about 0.100 inch and incorporated into the uncured propellant which is cured to a grain. When subjected to heat the tubing had a shrinkage of length-to-diameter ranging from about 1:2 to about 1:4.

Figure 2:
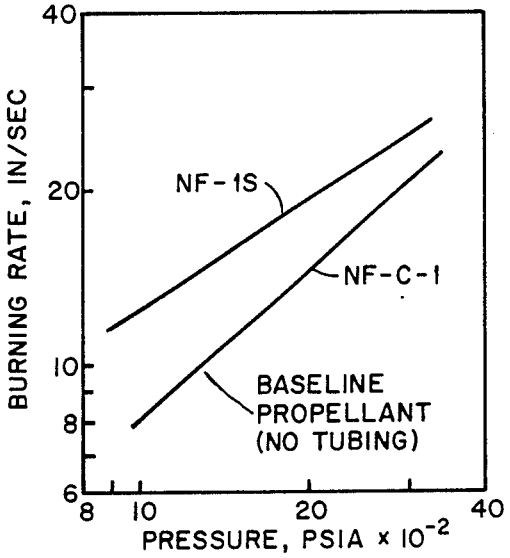
Figure 3:
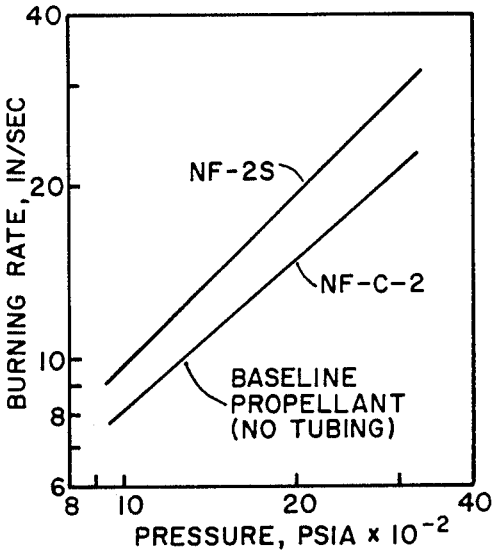
Figure 4:
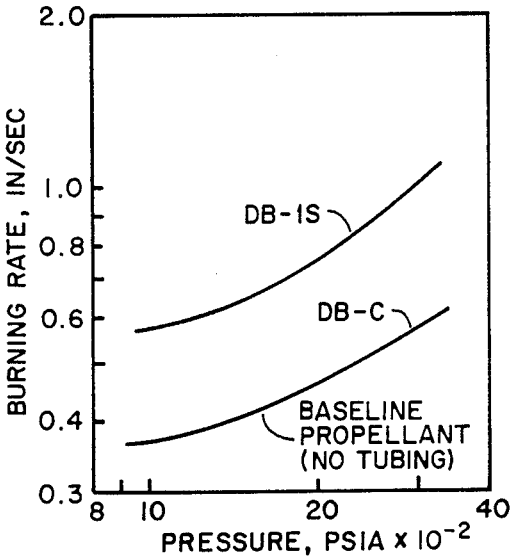
FIG. 4 depicts burning rates of a double base propellant.

In further reference to the drawing, FIG. 1 is a burning rate curve which shows the burning rate vs pressure for control propellant NF-C and modified propellant NF-1 containing 1% polyolefin white tubing 0.046 inch ID. FIG. 2 is a burning rate curve which shows the burning rate vs pressure for control propellant NF-C-1 and modified propellant NF-1S containing 1% stretched thermally-shrinkable tubing (stretched 6/1), 0.050 inch long. FIG. 3 is a burning rate curve which shows the burning rate vs pressure for control propellant NF-C-2 and modified propellant NF-2S containing 2% stretched thermally-shrinkable tubing (stretched 6/1), 0.050 inch long. FIG. 4 is a burning rate curve which shows the burning rate vs pressure for control propellant DB-C and modified propellant DB-1S containing 1% tubing, Frankel polyolefin, stretched, 6:1 (0.01"×0.030" ID).

The burning rate evaluations show that tubing as an additive is particularly effective for increasing the burning rate of high rate NF propellants as well as a lower burning rate double-base propellant. The maximum burn rate increase resulted from the prior stretched tubing that was added in amounts from about 1% to 2% to the propellant. The propellant was then exposed to a temperature of about 250° F. to achieve uniform temperature and to allow for the tubing to shrink and thereby increase porosity. Thus, as noted previously hereinabove, the preheating approach is attractive for use where it is desired to heat-sterilize propellant for outerspace applications and also obtain a propellant with increased burning rate.

I claim:

1. A method of enhancing the rate of consumption of a propellant as a result of having shrink tubing embedded in the propellant, said method comprising:

(i) formulating and mixing a curable propellant composition selected from the group consisting of a difluoroamino containing propellant composition comprised of a predetermined weight percentages of an ethyl acrylate-acrylic acid copolymer binder plasticized with 1,2,3-tris[1,2bis(difluoroamino)ethoxy] propane, a 4,5-epoxycyclohexylmethyl 4',5'-epoxycyclohexylcarboxylate curing agent, ultrafine ammonium perchlorate oxidizer of about 1 micrometer particle size coated with tris[2-ethylaziridinyl]-1,3,5-benzene-1,3,5-tricarboxamide, carboranylmethyl propionate, graphite linters, aluminum powder, aluminum flake, fine ammonium perchlorate oxidizer of about 0.9 micrometer, and lecithin; and a double-base propellant composition comprised of predetermined weight percentages of a binder of nitrocellulose lacquer, methyl nadic anhydride, carbon black, lead peroxide, stamic oxide, organic oxidizer of cyclotetramethylenetetranitramine, hexamethylene diisocyanate curing agent, triphenylbismuthine curing catalyst, maleric anhydride, and magnesium oxide;

(ii) adding a predetermined amount, from about 1 weight percent to about 2 weight percent of said uncured propellant composition, of a heat-shrinkable tubing comprised of material selected from a polyurethane or a polyolefin resin having a predetermined inside diameter from about 0.030 inch to about 0.125 inch and as outer diameter from about 0.070 inch to about 0.165 inch;

(iii) curing said propellant composition to form a solid propellant grain containing said heat shrinkable tubing dispersed throughout; and, (iv) exposing said solid propellant grain to heat which causes said heat shrinkable tubing to shrink, and thereby increase the porosity of said solid propellant grain which provides a method of enhancing the rate of consumption of said solid propellant grain during the burning thereof.

2. The method of claim 1 wherein said curable propellant selected is a difluoroamino propellant composition comprised of said ingredient as follows:

ethyl acrylate-acrylic acid copolymer containing about 95 parts ethyl acrylate and about 5 parts acrylic acid in an amount of about 3.00 weight percent; tris-1,2,3-[bis(1,2-difluoroamino) ethoxy] propane in an amount of about 29.99 weight percent; ammonium perchlorate oxidizer coated with about 0.3% weight percent of tris[2-ethylaziridinyl]-1,3,5-benzene-1,3,5-tri-carboxamide in an amount of about 52.00 weight percent; carboranylmethyl propionate in an amount of about 4.00 weight percent;

aluminum powder in an amount of about 10.00 weight percent; aluminum flake in an amount of about 2.00 weight percent; lecithin in an amount of about 0.10 weight percent and a predetermined amount of about 1 weight percent of polyolefin white tubing of about 0.046 inch inside diameter about 0.085 outer diameter, and about 0.05 inch in length.

3. The method of claim 2 wherein said polyolefin white tubing has been prior stretched about 6 to 1 and cut to said length before adding to said difluoroamino propellant composition.

4. The method of claim 3 wherein said exposing to heat consists of preheating the tubing-containing solid propellant grain to achieve a temperature of about 250° F. to preshrink said tubing to produce porosity and matrix/filler debonding in said solid propellant grain, said porosity and matrix/filler debonding providing a method of enhancing the rate of consumption of said solid propellant grain during the burning thereof.

5. The method of claim 1 wherein said curable propellant selected is a double-base propellant composition comprised of a predetermined weight percentages of said binder of nitrocellulose lacquer in an amount of about 39.43 weight percent; of said methyl nadic anhydride in an amount of about 1.00; of said carbon black in an amount of about 0.20 weight percent; of said lead peroxide in an amount of about 0.30 weight percent; of said stannic oxide in an amount of about 1.40 weight percent; of said organic oxidizer of said cyclotetramethylenetetranitramine in an amount of about 56.30 weight percent; of said hexamethylene diisocyanate in an amount of about 1.37 weight percent; of said triphenylbismuthine curing catalyst in an amount of about 0.03 weight percent; of said maleic anhydride in an amount of about 0.03 weight percent; of said magnesium oxide in an amount of about 0.03 weight percent; and a predetermined amount of about 1% of polyolefin white tubing of about 0.030 inch inside diameter, about 0.085 outer diameter, and of about 0.01 inch in length.

6. The method of claim 5 wherein said polyolefin white tubing has been prior stretched about 6 to 1 and cut to said length before adding to said double-base propellant composition.

7. The method of claim 6 wherein said exposing to heat consists of preheating the tubing-containing solid propellant grain to achieve a temperature of about 250° F. to preshrink said tubing to produce porosity and matrix/filler debonding in said solid propellant grain, said porosity and matrix/filler debonding providing a method of enhancing the rate of consumption of said solid propellant grain during the burning thereof.

8. The method of claim 1 wherein prior to adding a predetermined amount of said heat-shrinkable tubing, said heat-shrinkable tubing is filled with a rapidly-combustible propellant which burns more rapidly than the uncured propellant when said propellant is cured to a solid propellant grain containing said propellant filled heat-shrinkable tubing dispersed throughout.

* * * * *